US012448011B2

(12) United States Patent
Wait et al.

(10) Patent No.: US 12,448,011 B2
(45) Date of Patent: Oct. 21, 2025

(54) SYSTEMS AND METHODS FOR DISENGAGING LOCOMOTIVES FROM AUTONOMOUS CONTROL

(71) Applicant: Progress Rail Locomotive Inc., LaGrange, IL (US)

(72) Inventors: Keith Wesley Wait, Flower Mound, TX (US); Marcos Blanco Fernandes, Irving, TX (US); Francis R Wawrzyniak, Satellite Beach, FL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 62 days.

(21) Appl. No.: 18/524,617

(22) Filed: Nov. 30, 2023

(65) Prior Publication Data

US 2025/0178648 A1 Jun. 5, 2025

(51) Int. Cl.
*B61C 17/12* (2006.01)
*B61L 15/00* (2006.01)

(52) U.S. Cl.
CPC ..... *B61C 17/12* (2013.01); *B61L 15/0027* (2013.01)

(58) Field of Classification Search
CPC ..... B61C 17/12; B61L 15/0027
USPC ..... 701/19, 20
See application file for complete search history.

(56) References Cited

U.S. PATENT DOCUMENTS

| | | | |
|---|---|---|---|
| 4,602,335 | A | 7/1986 | Perlmutter |
| 6,587,764 | B2 | 7/2003 | Nickles et al. |
| 8,095,253 | B2 | 1/2012 | Kane et al. |
| 8,398,405 | B2 | 3/2013 | Kumar |
| 9,527,518 | B2 | 12/2016 | Lacy |
| 10,807,625 | B2 | 10/2020 | Shubs, Jr. |
| 2022/0063686 | A1 | 3/2022 | Brooks |
| 2022/0194440 | A1 | 6/2022 | Akif |

FOREIGN PATENT DOCUMENTS

WO WO 2013/172840 A1 * 11/2013 ..... B60L 15/32

* cited by examiner

*Primary Examiner* — Hai H Huynh
(74) *Attorney, Agent, or Firm* — Lee & Hayes, P.C.

(57) ABSTRACT

An energy-management system of a train includes a consist disengagement module configured to control disengagement of a train consist from an autonomous mode to a manual mode of operation. After receiving an instruction to disengage, the system determines an engaged power of the consist in the autonomous mode and calculates an effective position for a consist throttle where the consist would generate a disengaged power in manual mode most closely approximating the engaged power. After causing the throttle handle to be moved to the effective position, the consist disengagement module incrementally changes the operational settings for either a lead locomotive or a trail locomotive until the operational settings match the effective position for the consist throttle. The system chooses the changes to maintain the consist output power close to the disengaged power, avoiding surges in consist power and minimizing handling disturbances during disengagement.

20 Claims, 5 Drawing Sheets

SYSTEMS AND METHODS FOR DISENGAGING LOCOMOTIVES FROM AUTONOMOUS CONTROL

TECHNICAL FIELD

The present disclosure relates to disengaging locomotives within a consist from autonomous control by an energy-management system. More specifically, the present disclosure relates to an electronic control system transitioning output power of locomotives operating at different throttle levels from an autonomous mode to a manual mode.

BACKGROUND

A group of locomotives, called a consist, can provide motive force for propelling a train along a route during a trip, or mission. A lead locomotive contains controls for managing behavior of the trail locomotives in the consist via a communications network. In a manual mode of operation, a train engineer controls the amount of power applied to traction motors in the locomotives by sliding a throttle handle across a series of discrete settings, or notches. The operator can increase or decrease the total tractive-effort power applied by pivoting the handle sequentially from idle at throttle notch setting TN0 to maximum power, which is traditionally at throttle notch setting TN8. To enhance energy efficiency and overall operation during the trip, the train may instead operate in an autonomous, or semi-autonomous, mode. In this mode, an energy-management system within the lead locomotive automatically controls or manages operating parameters of the consist, such as adjusting power output from the locomotives, according to various algorithms.

Traditionally, the locomotives were controlled according to a common throttle command. When a train engineer changed the throttle handle or the energy-management system updated a throttle value, throttles in each locomotive changed the same. To conserve fuel during a mission, however, control options now exist for setting throttles in locomotives separately to account for operational differences between these locomotives. With these options, when the throttle notch is selected in the lead locomotive by the throttle handle or the energy-management system, the throttle in other locomotives may be set to an optimal position for providing the required power and tractive effort for the consist while enhancing fuel efficiency.

In disengaging from autonomous mode and returning to manual mode, energy-management systems apply a common throttle position for all locomotives in the consist equal to the value of the lead locomotive throttle at the time of disengagement. For any trail locomotives operating at different throttle values, the energy-management system transitions those throttle values to match the lead locomotive throttle. Those transitions of power within the trail locomotives can be substantial, however. In addition, the total consist power at a common throttle position equal to the lead locomotive throttle may be different from the total consist power when disengagement begins. These power differences can impact train handling and require corrective adjustments by the train engineer when taking over manual operation.

One process for disengaging a consist from an autonomous mode is described in U.S. Pat. No. 9,527,518 ("the '518 patent"). In the '518 patent, a train controlled autonomously may operate with locomotives at different notch power levels and may transition to a manual mode under a variety of conditions, such as removing the throttle handle from a preset position, pressing a key, or activating a switch. The control system may provide a time delay before manual control takes over and may provide a list of actions and information through a display screen to assist with the process. The '518 patent, however, does not address independent throttle settings for locomotives during disengagement from an automatic mode. Nor does it explain the output power configured for the consist following transition to manual mode.

Examples of the present disclosure are directed to overcoming deficiencies of such systems.

SUMMARY

In an aspect of the present disclosure, a computer-implemented method includes operating a consist of locomotives of a train in an autonomous mode by providing, to a lead locomotive of the consist, a lead autonomous setting corresponding to tractive effort to be delivered by the lead locomotive in the autonomous mode and by providing, to a trail locomotive of the consist, a trail autonomous setting different from the lead autonomous setting and corresponding to tractive effort to be delivered by the trail locomotive in the autonomous mode. The method further includes receiving an instruction to disengage the consist from the autonomous mode and identifying an engaged power of the consist when operating at the lead autonomous setting and the trail autonomous setting. A position of a consist throttle is determined, among a set of positions, that results in a disengaged power of the consist in a manual mode, where the disengaged power is closer to the engaged power with the consist throttle in the position compared with the consist throttle in another of the positions. The method further includes causing the consist throttle to be moved to the position and incrementally changing one of the lead autonomous setting and the trail autonomous setting until the lead autonomous setting and the trail autonomous setting are at a disengagement setting. The disengagement setting is equivalent to the consist throttle being in the position. Finally, the consist is disengaged from the autonomous mode.

In another aspect of the present disclosure, a control system for a consist of locomotives includes a throttle configured to indicate an overall amount of power to be delivered by the consist in a manual mode, where settings of the throttle indicate respective levels of the power, and an energy-management system coupled to the throttle. The energy-management system is configured to indicate a first amount of power to be delivered by a lead locomotive of the locomotives and a second amount of power to be delivered by a trail locomotive of the locomotives in an autonomous mode. The energy-management system includes a lead throttle module configured to instruct the lead locomotive to provide a lead power equivalent to the throttle being in a lead setting, and in response to the throttle being moved to a disengaged setting, instruct the lead locomotive to change the lead power incrementally to become equivalent to the throttle being in a disengaged setting. The energy-management system further includes a trail throttle module configured to instruct the trail locomotive to provide a trail power equivalent to the throttle being in a trail setting, and in response to the throttle being moved to the disengaged setting, instruct the trail locomotive to change the trail power incrementally to become equivalent to the throttle being in the disengaged setting. In addition, the energy-management system includes a consist disengagement module configured to receive a command to disengage the consist from the autonomous mode, identify an engaged power of the consist when operating in the autonomous mode, predict a first power of the consist when the throttle is in the lead setting for the consist, and predict a disengaged power of the consist when the throttle is in the disengaged setting for the consist, where the disengaged setting is different than the lead setting. As well, the consist disengagement module is configured to determine that the disengaged power would be closer to the engaged power than would the first power, cause the throttle to be moved to the disengaged setting, and disengage the consist from the autonomous mode and into the manual mode.

In yet another aspect of the present disclosure, a consist of locomotives for a train includes a lead locomotive having a throttle configured for controlling power from the consist in a manual mode, where settings of the throttle indicate respective levels of the power, a trail locomotive coupled by the lead locomotive via a communication network, and an electronic control system at least partially within the lead locomotive. The electronic control system, controlling power from the consist in an autonomous mode, is configured to instruct the lead locomotive to provide a lead power equivalent to the throttle being in a lead setting, instruct the trail locomotive to provide a trail power equivalent to the throttle being in a trail setting, receive a command to disengage the consist from the autonomous mode, and identify an engaged power of the consist operating in the autonomous mode. In addition, the electronic control system is configured to predict a first power of the consist when the throttle is in the lead setting for the consist and predict a disengaged power of the consist when the throttle is in a disengaged setting for the consist, where the disengaged setting is different than the lead setting. The electronic control system is further configured to determine that the disengaged power would be closer to the engaged power than would the first power, cause the throttle to be moved to the disengaged setting, instruct the lead locomotive to change the lead power incrementally to become equivalent to the throttle being in the disengaged setting, and instruct the trail locomotive to change the trail power incrementally to become equivalent to the throttle being in the disengaged setting. Finally, the electronic control system is configured to disengage the consist from the autonomous mode and into the manual mode.

BRIEF DESCRIPTION OF DRAWINGS

The detailed description references the accompanying figures. In the figures, the left-most digit of a reference number identifies the figure in which the reference number first appears. The same reference numbers indicate similar or identical items.

DETAILED DESCRIPTION

Consistent with the principles of the present disclosure, an energy-management system of a train includes a consist disengagement module configured to control disengagement of a train consist from an autonomous mode to a manual mode of operation. After receiving an instruction to disengage, the system determines an engaged power of the consist in the autonomous mode and may calculate an effective position for a consist throttle where the consist would generate a disengaged power in manual mode most closely approximating the engaged power. After causing the throttle handle to be moved to the effective position, the consist disengagement module incrementally changes the operational settings for either a lead locomotive or a trail locomotive until the operational settings match the effective position for the consist throttle. The system chooses the changes to maintain the consist output power close to the disengaged power, avoiding surges in consist power and minimizing handling disturbances during disengagement. The following describes several examples for carrying out the principles of this disclosure.

Figure 1:
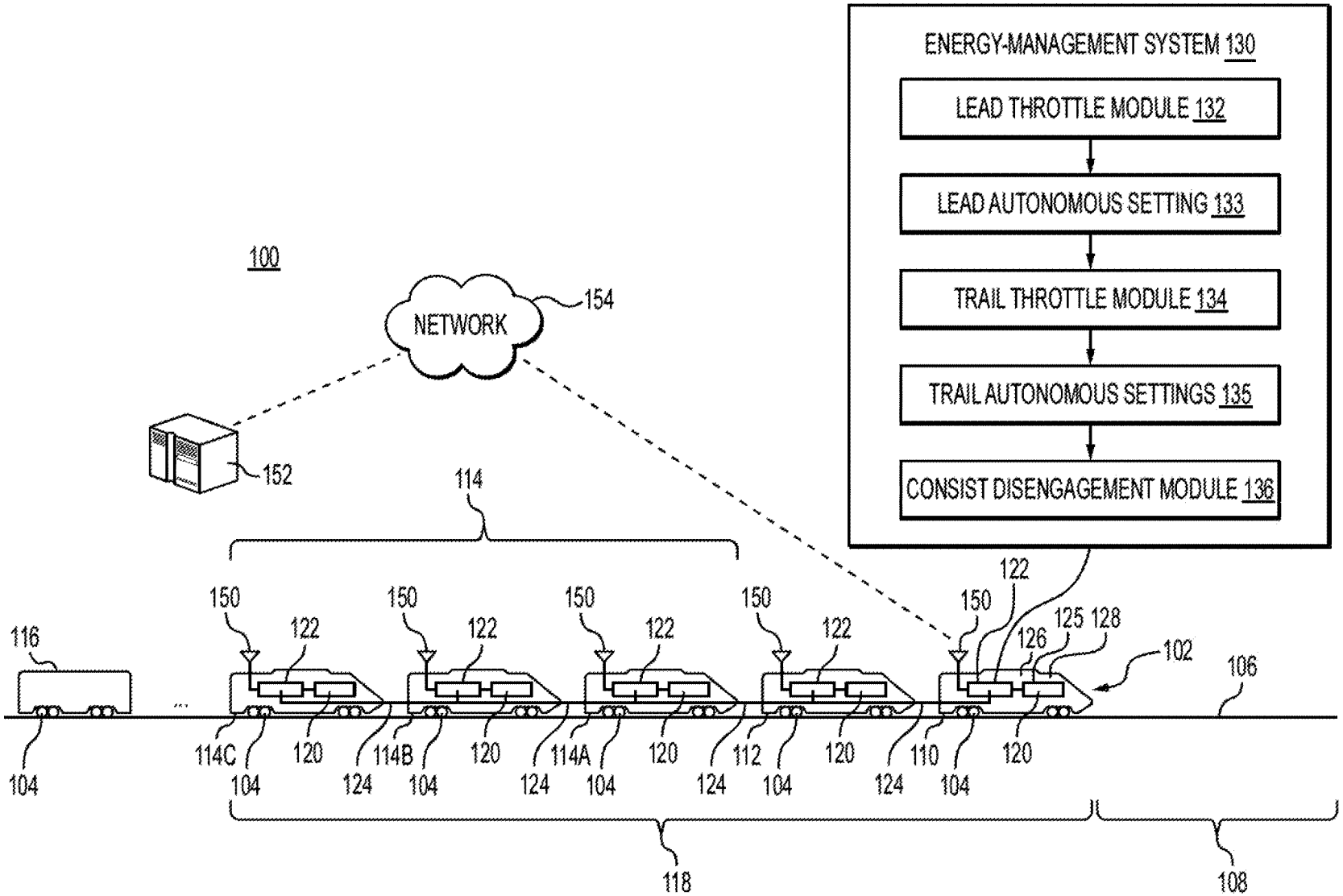
FIG. 1 is a schematic diagram of a train system in accordance with an example of the present disclosure.

FIG. 1 is a schematic diagram of a train system 100 for controlling deployment of locomotives within a consist as one example suitable for carrying out the principles discussed in the present disclosure. Exemplary train 102 functions as a rail vehicle and travels on wheels 104 along route 106 from a source to a destination (from left to right in FIG. 1). As train 102 travels along route 106, an upcoming distance 108 extends in front of the train.

Train 102 includes several rail cars or units, which are either powered units or nonpowered units, linked together. "Powered units" refers to rail cars that are capable of self-propulsion, such as locomotives. "Nonpowered units" refers to rail cars that are incapable of self-propulsion, but which may otherwise receive electric power for other services, such as freight cars or passenger cars. In FIG. 1, train 102 includes powered units at least in the form of lead locomotive 110, nonaddressable locomotive 112, and addressable locomotives 114, along with nonpowered unit 116. This arrangement is exemplary. Fewer powered units may be present, or additional powered units and nonpowered units of any variety may be included in train 102. For instance, while the powered units in FIG. 1 are arranged in a consist 118, additional consists may be present at other locations within train 102. Further, the rail cars may be arranged in any order within train 102 without departing from the principles of this disclosure.

The lead locomotive 110 serves as a center for management and control for other powered units. The term "lead" in lead locomotive 110 refers in this context to a powered unit that is designated for primary control of other locomotives within consist 118. While illustrated at the front of train 102, lead locomotive 110 may be located at any position. A propulsion system 120 within lead locomotive 110 provides power for delivering tractive effort to help cause train 102 to move along wheels 104 as well as braking effort to reduce or stop the movement. Propulsion system 120 includes electric and/or mechanical devices and components, such as diesel or electric engines, electric generators, and traction motors, used to provide tractive effort that propels train 102. Braking effort may arise from dynamic braking, rheostatic braking, frictional braking, or other means in conjunction with propulsion system 120 as known to those of ordinary skill in the field.

The powered units within consist 118 other than lead locomotive 110 may be referred to as trailing units or trailing locomotives. Consist 118 of FIG. 1 includes four interconnected, trailing locomotives besides lead locomotive 110. In this context, "trailing" or "trail" refers to powered units that are under at least partial control of lead locomotive 110 and does not necessarily reflect positioning of the powered units within consist 118 or within train 102. These trailing powered units are mechanically coupled or linked to each other and to lead locomotive 110, to travel along route 106. For instance, in FIG. 1, a nonaddressable locomotive 112 is immediately behind lead locomotive 110, followed by three addressable locomotives 114. The order of these locomotives with consist 118 may be different than is shown, and nonpowered units may be placed between the powered units. The trailing locomotives, such as nonaddressable locomotive 112 and addressable locomotives 114, each have a propulsion system 120 as with lead locomotive 110 for providing tractive and braking effort for assisting in movement of train 102.

Additionally, the powered locomotives within consist 118 include at least some portion or form of control system 122 for electronically monitoring, managing, controlling, or executing various operations within consist 118. Typically, lead locomotive 110 contains a control system 122, whether implemented as a discrete control system within that lead locomotive or a portion of a collective control system distributed across each locomotive in consist 118, that acts as a central controller for operations within itself and the other locomotives within consist 118. In some examples, control system 122 resides at least within lead locomotive 110 within an onboard controller and embodies one or more computer processors that include a means for operating and/or controlling train 102 based on information obtained from sensors monitoring various train components, from data stored in memory, from communications received external to the locomotive, and other sources. Control system 122 may include computer-readable media in the form of a memory, a secondary storage device, a processor, and any other components for executing instructions stored on the computer-readable media. The memory may include a non-transitory computer-readable medium, such as RAM, ROM, FLASH memory, CD ROM, magnetic devices (e.g., disks, tape, etc.), and/or other types of memory. Various other circuits may be associated with a controller such as power supply circuitry, signal conditioning circuitry, solenoid driver circuitry, and other types of circuitry. Different modules and functions of control system 122 are discussed in more detail below.

An operator cabin, or cab 125, is positioned at a front of lead locomotive 110 facing the direction of travel along route 106. The operator, or engineer, of train 102 is stationed within cab 125 during operation. Control system 122 receives input from the operator via a human-machine interface (HMI), at least a portion of which may be implemented in cab 125 through a control panel 200, shown in FIG. 2. In a typical arrangement, control panel 200 is situated as part of a workstation for the operator. In some examples, control panel 200 is incorporated in a dashboard in cab 125 within the operator's field of view below a windshield and generally facing in the direction of travel of train 102. Control panel 200 enables the operator to control or otherwise affect the operation of the power system for train 102, such as starting, stopping, and accelerating propulsion system 120, applying dynamic braking, and other functions. In some examples, control panel 200 may comprise a variety of instruments and controls, such as a throttle, a directional control lever, a dynamic braking control, and one or more computer displays. From these and other instruments and controls, operating commands are provided to control system 122 for managing behavior of train 102 in a manual mode of operation.

Within control panel 200, mechanical controls 202 are illustrated clustered at a left side. Mechanical controls 202 represent traditional controls present in many legacy locomotives. For example, mechanical controls 202 may include a throttle handle, an automatic brake control, an independent brake handle, a generator switch, a lighting control, and/or other controls. These and other operational control devices may embody levers, knobs, switches, buttons, slides, handles, touchscreens, and soft keys, among other types of controls.

Figure 2:
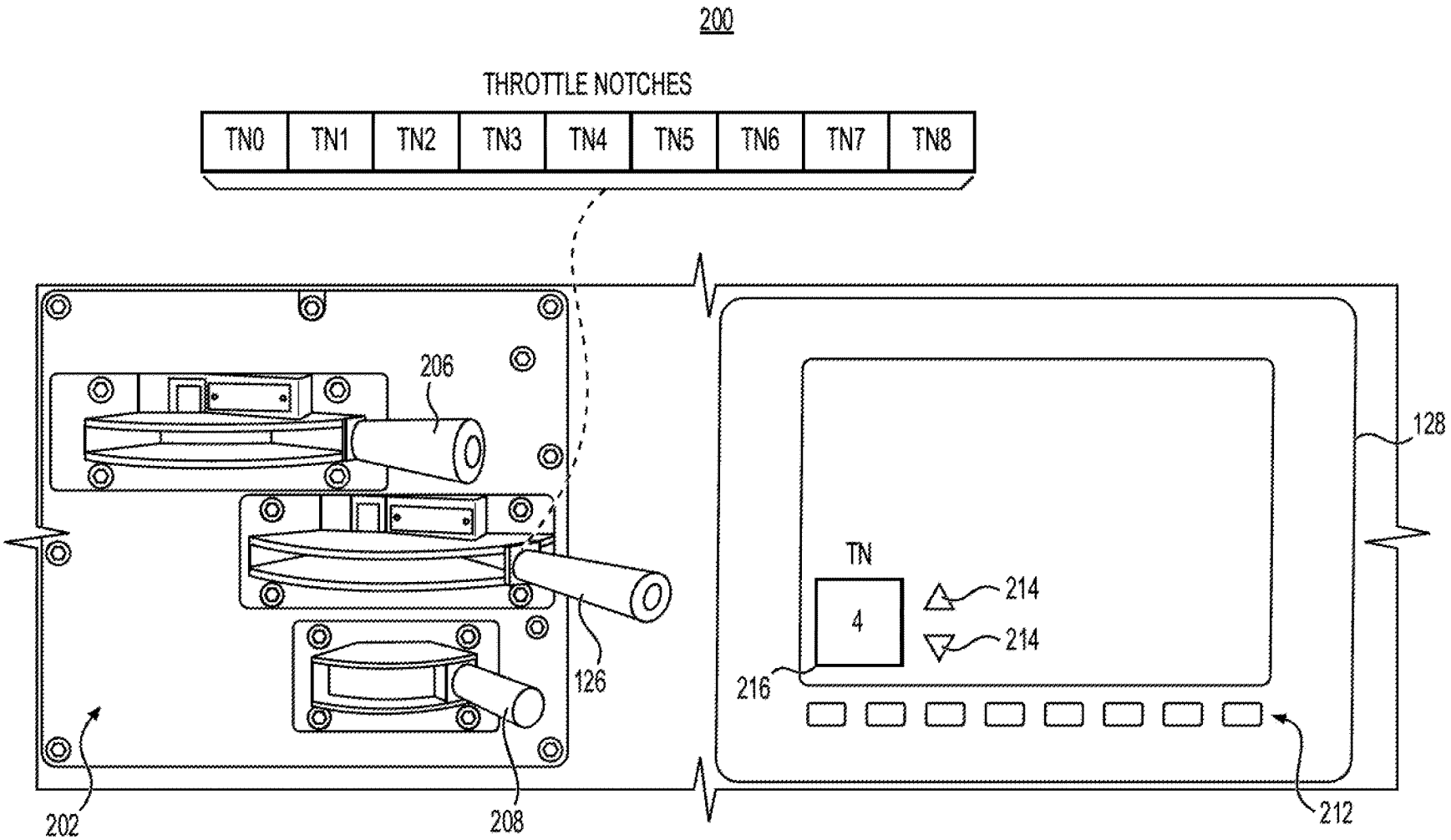
FIG. 2 is a plan view of a control panel within a cab of the lead locomotive of FIG. 1 in accordance with an example of the present disclosure.

Although implementations may vary, as selectively illustrated in FIG. 2, certain legacy controls include handled levers that may be pivoted horizontally about a vertical axis within control panel 200. The operator of train 102 can slide the handled levers left or right to adjust a function. For example, in the center of mechanical controls 202 in FIG. 3, the operator can grasp and move a throttle handle 126 horizontally from right to left to adjust the throttle value applied to propulsion system 120 in each of the locomotives, thus setting the total power delivered by consist 118. Although shown in FIG. 3 as a slidable handle, throttle handle 126 may alternatively be a switch, dial, slide, handle, knob, lever, pedal, or any other type of control device.

In the disclosed example, consistent with legacy locomotives, throttle handle 126 begins at a far right of its range of movement at an engine idle position and may be movable to a maximum position at the far left of its range of movement. Across that range, throttle handle 126 is movable through a sequence of stops or detents corresponding to throttle notch positions (TN). In typical examples for legacy locomotives, beyond a starting idle position (essentially TN0), throttle handle 126 will stop at eight notch positions (e.g., TN1-TN8) that each corresponds to increasing amounts of power selected for delivery to propulsion system 120. Accordingly, moved through notches TN1-TN7 to reach its far left position at TN8, throttle handle 126 will provide a maximum available power selectable by the operator for delivery to propulsion system 120.

As further indicated in FIG. 2, mechanical controls 202 may include additional levers for operating train 102. For instance, dynamic brake 206 enables the operator to engage dynamic braking by sliding a lever on control panel 200 accordingly. Also, at a bottom of mechanical controls 202, an operator may slide a reverser 208 to change direction of train 102. Typically, reverser 208 directs train 102 to be in neutral when in a center position of its range of motion, to be in reverse when in a leftmost position, and to be in forward when in a rightmost position.

Additionally, control panel 200 includes at least one computer terminal or monitor 128 functioning as an operator interface, as shown in FIG. 2. Monitor 128 may be configured to receive input from the operator to give computer or electronic instructions to control system 122 for controlling train 102. Although not fully illustrated, monitor 128 may include a keyboard, mouse, touchscreen, directional pad, selector buttons, or any other suitable features for recording manually entered data. As examples, monitor 128 may include soft keys 212, touchscreen keys 214, and display icons 216. Accordingly, monitor 128 permits the operator to learn about and monitor the performance of train 102 from information shown on a screen, while possibly also interacting with monitor 128 to affect behavior of the train.

Monitor 128 may also be configured to display data from the outputs of one or more of machine gauges, indicators, sensors, and controls as a consolidated or integrated source for operator information. As such, monitor 128 may include a graphical user interface (GUI) configured to display information associated with the train. The GUI may be a graphic display tool including menus (e.g., drop-down menus), modules, buttons, toolbars, text boxes, field boxes, windows, and other means to facilitate the conveyance and transfer of information between a user and control panel 200.

Returning to FIG. 1, train 102 also includes communication system 150 at least for wirelessly transmitting and receiving electrical signals with offboard remote electronics external to the train. Communication system 150 is communicatively coupled with control system 122 in at least one or more of the powered locomotives and includes one or more antennas for facilitating wireless communication. Communication system 150 may include electronic components for facilitating communication within a railroad network under protocols and standards known to those of ordinary skill in the field. Examples include a cellular connection following TDMA, 3G, 4G, 5G, or other protocol, a wireless local area network (WLAN), WiMax (Worldwide Interoperability for Microwave Access), satellite communications, and the like. In one example, communication system 150 connects wirelessly with a back-office system 152, which may include mainframe computers and other storage devices for housing information relevant to the operation, routing, and scheduling of train 102 along route 106.

As depicted in FIG. 1, communication system 150 facilitates wireless communications between train 102 and a railyard back-office system 152, a remotely located server, a third-party server, and the like, via a wireless network 154. The back-office system 152 may include a computer system configured for planning, monitoring, and adjusting schedules and movement of trains within a railroad network. The back-office system 152 may be in continuous or intermittent communication with communication system 150 on train 102 before and during movement of the train along route 106.

In some examples, communication system 150 in conjunction with control system 122 coordinates operations of various components and subsystems, such as propulsion system 120 within each of the powered units of consist 118. The communication system 150 within lead locomotive 110 may be referred to as a lead communication unit that initiates a message to back-office system 152 containing information on an operational state of lead locomotive 110, such as a throttle setting, a brake setting, readiness for dynamic braking, the tripping of a circuit breaker, or other operational characteristics. Communication system 150 within lead locomotive 110 may communicate with the communication system 150 within other powered units of consist 118, which are interconnected via a network connection 124. In one example, network connection 124 includes a net port and jumper cable that extends along train 102 and between each control system 122 of the powered units. The network connection 124 may be a multiple unit cable (MU cable), an Electrically Controlled Pneumatic brake line (ECPB), a fiber optic cable, other cable configuration, or a wireless connection. Similarly, network connection 124 may connect and communicatively couple propulsion system 120 of the locomotives in consist 118. High speed communication networks may be employed in consist 118 using a common ethernet communication bus. The ethernet communication signals may be superimposed over other digital communication signals carried by some of the wires in MU cables. MU cables provide trainline communications between the locomotives in a consist, including operational commands such as throttle control settings. The networking standard employed in the consist may include an inter-consist communication (ICC) router and an ethernet bridge device on each car.

In some examples, network connection 124 includes several channels over which network data is communicated with each channel representing a different pathway for network data. In some examples, one or more channels within network connection 124 may communicate a trainline command accessible by all rail cars within train 102. In this situation, the information conveyed within the trainline command is general to all rail cars and is generally not specific to a particular locomotive. In other examples, control system 122 within one or more of the locomotives, such as addressable locomotives 114 within consist 118, have the capacity to be directly and uniquely addressed by lead locomotive 110. For instance, control system 122 within addressable locomotives 114 may abide by LCCM protocols and enable direct communication from control system 122 in lead locomotive 110. On the other hand, some powered units in train 102, such as nonaddressable locomotive 112, may not have the capacity to be directly addressed by lead locomotive 110 and must rely on trainline communications. These communication options are provided as examples and are not limiting to the present disclosure. Various options for communicating between railcars are available and within the knowledge of those of ordinary skill in the field.

While control panel 200 enables an operator to control many features of train 102 in a manual mode, other features of current locomotives are reserved for computer control. For instance, monitor 128 may include a mechanism for an operator to select an autonomous mode of operation for consist 118. The term "autonomous mode" refers to any level of decision-making and control over the operation of a train by a computer algorithm or similar automatic features, whether wholly automated or partially under human control, and is meant to include semi-autonomous operation under human supervision. When an autonomous mode is activated for train 102, such as through monitor 128 and other type of input signaling to control system 122, a contribution of power selected by throttle handle 126 between different ones of the locomotives in consist 118 may remain under computer command according to control system 122. As embodied within lead locomotive 110, control system 122 includes an automatic train operation (ATO) system that has an energy-management system 130 embedded within or in electronic communication at least with propulsion system 120. Energy-management system 130 is an automated module or software engine within control system 122 configured to generate command signals to optimize control of train 102 under currently detected circumstances during an autonomous mode of operation. In this context, a module or engine refers to hardware, software, or combinations of hardware and software configured to store and execute computer-readable instructions for a particular task.

After engagement of the autonomous mode from a manual mode, typically by an operator of train 102 within cab 125, control system 122 receives input signals from a variety of sensors and other inputs indicative of operating parameters of the train and generates output signals for achieving optimum control of the train. The automated energy management system may be configured to make these output signals or requests based on a variety of measured operational parameters, track conditions, freight loads, trip plans, and predetermined maps or other stored data with a goal of improving availability, safety, timeliness, overall fuel economy and emissions output for the entire train. For example, energy-management system 130 may generate command signals for automatically controlling throttle, braking, and or other aspects of train 102 associated with propulsion system 120 based on the current operating parameters and health condition of the locomotive, along with the current mission, location, and topography, in order to achieve optimum performance while accomplishing mission goals and objectives. Mission goals and objectives may include achieving performance goals (e.g., performance levels, efficiency levels, etc.), adhering to schedules, and obeying laws (e.g., speed limits). The energy-management system may also control or modify operating parameters for train 102 to maximize fuel efficiency and/or to minimize emissions. As discussed further below, decisions and command signals generated within energy-management system 130 may involve and be shared with other locomotives within consist 118.

As indicated in FIG. 1, energy-management system 130 includes several modules or engines embedded within its operation. For instance, lead throttle module 132 includes electronic hardware, software, or combinations of hardware and software configured to store and execute computer-readable instructions for setting or adjusting the power supplied by propulsion system 120 within lead locomotive 110 during an autonomous mode of operation. In this example, energy-management system 130 controls activities such as propulsion and braking following stored algorithms without the need for operator interaction within cab 125. Thus, while throttle handle 126 remains set in a position, during autonomous operation, lead throttle module 132 may determine a different throttle value appropriate for lead locomotive 110 for the situation and electronically communicate that value, i.e., a lead autonomous setting, possibly through network connection 124, to propulsion system 120 of the lead locomotive. Typically, lead throttle module 132 selects one of lead autonomous settings 133 at a value that would generate tractive effort equivalent to a corresponding throttle notch on throttle handle 126. That is, lead autonomous settings 133 typically range discretely from 0-8 as with the TN0-TN8 on throttle handle 126.

Similarly, trail throttle module 134 includes electronic hardware, software, or combinations of hardware and software configured to store and execute computer-readable instructions for setting or adjusting the power supplied by propulsion system 120 within one or more of the trail locomotives during an autonomous mode of operation based on decisions reached by energy-management system 130. These trail locomotives may include any of nonaddressable locomotive 112 or addressable locomotives 114. In this way, energy-management system 130 controls activities such as propulsion and braking following stored algorithms without the need for operator interaction within cab 125. Thus, while throttle handle 126 remains set in a position, trail throttle module 134 may determine a different value appropriate for a trail locomotive for the situation, i.e., a trail autonomous setting, and communicate that value electronically, possibly through network connection 124, to propulsion system 120 of the trail locomotive. Typically, trail throttle module 134 selects one of trail autonomous settings 135 at a value that produces tractive effort equivalent to a corresponding throttle notch on throttle handle 126, i.e., ranging discretely from 0-8.

The amount of power generated by propulsion system 120 in a trail locomotive, such as any one of addressable locomotives 114, for a trail autonomous setting from trail throttle 134 may differ based on the characteristics of the engine and related equipment in the trail locomotive. Similarly, the amount of power generated by propulsion system 120 within lead locomotive 110 for an equivalent lead autonomous setting from lead throttle 132 may differ from the amount of power generated by any of the trail locomotives. In some examples, trail throttle module 134 controls the throttle value for all of the trail locomotives equally, which can be communicated as a trainline command along network connection 124. In other examples, one or more of addressable locomotives 114 are controlled independently via trail throttle module 134 network connection 124. For instance, nonaddressable locomotive 112 may be set at a first of trail autonomous settings 135, first addressable locomotive 114A may be set at a second of trail autonomous settings 135, and second addressable locomotive 114B and third addressable locomotive 114C may be set at a third of trail autonomous settings 135.

In accordance with the present disclosure, energy-management system 130 further includes a consist disengagement module 136 configured to coordinate and assist with disengagement of control system 122 from an autonomous mode. A disengagement process may be initiated in several ways. For instance, the operator may activate an appropriate one of soft keys 212 or touchscreen keys 214 within monitor 128. Or the operator may change a position on a physical switch, button, lever, or other actuator on control panel 200. As well, the operator may slide throttle handle 126 to a different notch position. Other examples of signaling a command or instruction to disengage from autonomous mode are possible, all of which provide control system 122 with an instruction for consist disengagement module 136 to begin moving from autonomous mode to manual mode.

Typically, operator controls within a lead locomotive, such as control panel 200 within lead locomotive 110, do not include mechanisms for the operator to manually control or drive a managed consist, i.e., a consist operating with different power settings for different locomotives such as may arise with lead throttle module 132 and trail throttle module 134 during autonomous mode. Accordingly, in some examples, when returning control of consist 118 to manual mode, energy-management system 130 within control system 122 adjusts the autonomous settings for each locomotive in the consist 118 to be at a same value so that throttle handle 126 may control the consist 118 in manual mode. Consistent with the principles of the present disclosure, consist disengagement module 136 first calculates or predicts an operational setting for the lead locomotive and the trail locomotive that would result in output power from consist 118 substantially equal to the output power of consist 118 when beginning the disengagement process. After identifying this operational setting, energy-management system 130 notifies the operator, such as through monitor 128, to move throttle handle 126 to the notch position corresponding to the autonomous operational setting. In some examples, following adjustment of throttle handle 126 by the operator, energy-management system 130 causes the one of lead autonomous settings 133 of the lead locomotive and the one or more of trail autonomous settings 135 for the trail locomotives to change from their positions incrementally through intermediate autonomous settings until they both reach the autonomous operational setting. As a result, the disengagement from autonomous mode avoids large changes in power from consist 118 and results in a final output power for manual mode substantially equal to the consist power when disengagement was requested. The following discussion in light of FIGS. 3-5 elaborate on this system and process.

Figure 3:
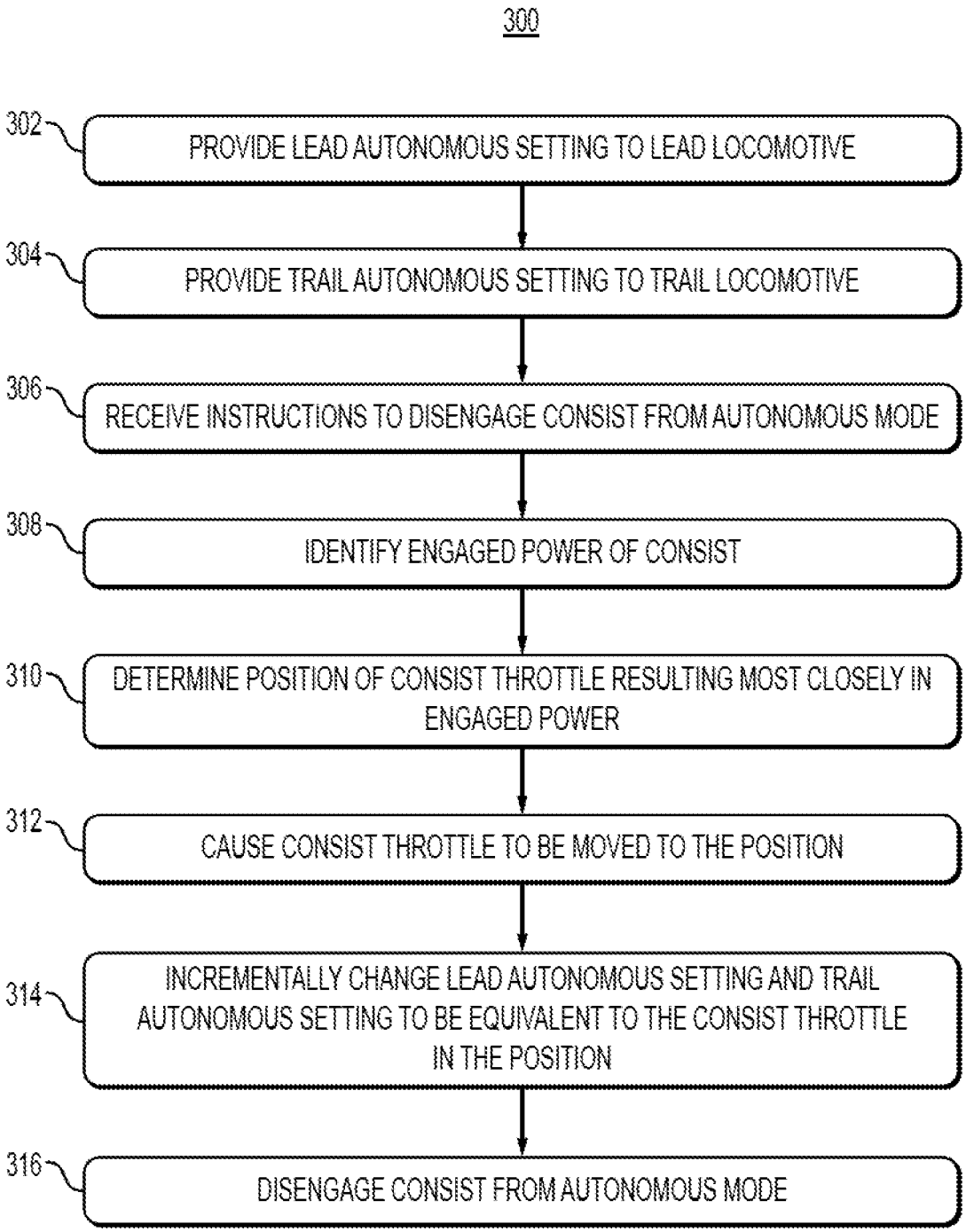
FIG. 3 is a flow diagram depicting a method of selectively deploying locomotives in a consist in accordance with an example of the present disclosure.

Turning from the architecture of 100 and options for disengaging locomotives from autonomous control, FIG. 3 is a flow diagram of a representative method 300 for performing disengagement within a consist. This method is illustrated as a logical flow graph, operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described operations may be combined in any order and/or in parallel to implement the process.

The method 300 in FIG. 3 begins with a step 302 in which a lead autonomous setting is provided to a lead locomotive. As noted above, consist disengagement module 136 along with energy-management system 130 is configured to determine based on various conditions of a mission for train 102, what appropriate operational settings should be for lead locomotive 110 in an autonomous mode. These operational settings may include parameters relating to engine settings and braking operation, among other things. In some examples, lead autonomous settings 133 indicate levels of tractive effort to be applied and substantially correspond to the throttle levels provided by throttle handle 126 at TN0-TN8. Therefore, to simulate operator control of lead locomotive 110 during the autonomous mode, consist disengagement module 136 provides to propulsion system 120 one of lead autonomous settings 133 corresponding to one of the notch positions on throttle handle 126.

In step 304, a trail autonomous setting is provided to a trail locomotive. Similar to step 302, consist disengagement module 136 along with energy-management system 130 is configured to determine based on various conditions of a mission for train 102, what appropriate operational settings should be for one or more trail locomotives in consist 118 in an autonomous mode. For purposes of this discussion, consist 118 includes only one trail locomotive, nonaddressable locomotive 112. While the lead autonomous setting and the trail autonomous setting may in some circumstances be equal, for operating a managed consist in autonomous mode, the lead autonomous setting differs from the trail autonomous setting.

Thereafter for method 300, instructions are received for disengaging the consist from the autonomous mode in step 306. As discussed above, consist disengagement module 136 receives the instructions for disengagement typically from an operator, such as through activation of one of soft keys 212 or touchscreen keys 214 within monitor 128 or by the operator changing a position throttle handle 126, on a physical switch, button, lever, or other actuator on control panel 200. Alternatively, consist disengagement module 136 may receive an instruction or command to disengage from autonomous mode from other sources, such as through control system 122 as part of energy-management system 130, through communication system 150 from back-office system 152, for instance.

Figure 4:
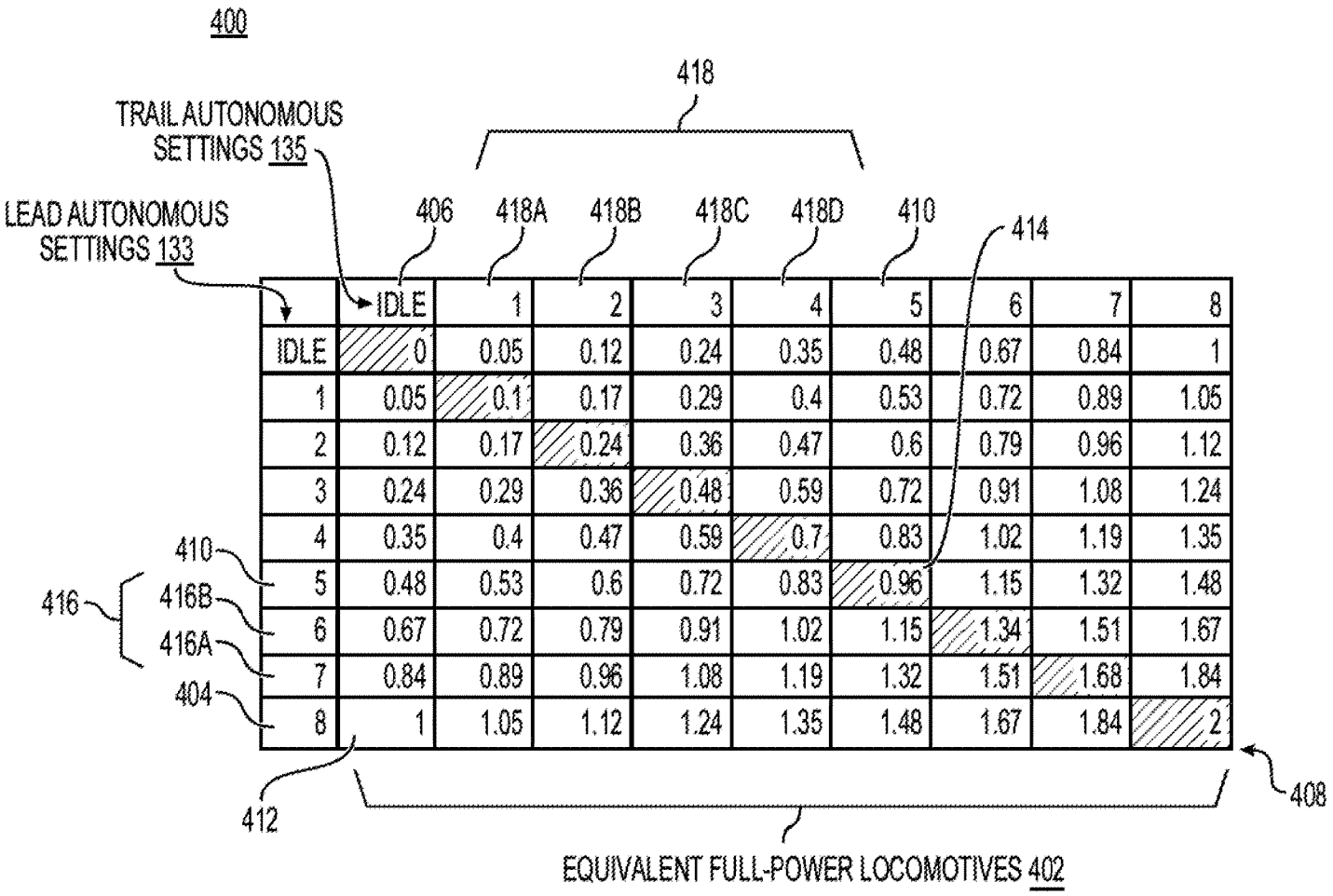
FIG. 4 is a table indicating equivalent locomotive power for a consist at the notch settings for a lead locomotive and a trail locomotive in accordance with an example of the present disclosure.

In step 308, an engaged power is identified for the consist operating in autonomous mode. The engaged power may be the combined output power of the locomotives operating in the consist at the time of the disengagement command. In some examples, consist disengagement module 136 determines this engaged power empirically through various sensors or other equipment installed within consist 118 in real time. In other examples, consist disengagement module 136 determines this engaged power theoretically by consulting data stored in memory (not shown) indicative of the power for a locomotive at the current throttle setting, i.e., at the selected one of lead autonomous settings 133 or trail autonomous settings 135. FIG. 4 illustrates an example of this data.

FIG. 4 is a power table 400 depicting equivalent locomotives at full tractive power, i.e., at notch position TN8, for a representative consist 118 formed by lead locomotive 110 and nonaddressable locomotive 112. The vertical axis of power table 400 contains lead autonomous settings 133, ranging from 0, or idle, to 8, as with throttle handle 126. The horizontal axis of power table 400 contains trail autonomous settings 135, also ranging from 0, or idle, to 8, as with throttle handle 126. The intersection of the rows and columns indicate the respective equivalent locomotive power for consist 118 resulting from the respective ones of the lead autonomous settings 133 and the trail autonomous settings 135. For purposes of illustration in FIG. 3, the performance characteristics of the lead locomotive and the trail locomotive, particularly output power at a throttle setting, are the same. Specifically, in the example of FIG. 3, the lead locomotive and the trail locomotive each have the following traction power in kilopounds at respective throttle notches TN0-TN8 in manual mode (or equivalently for lead autonomous settings 133 or trail autonomous settings 135 in autonomous mode):

| Throttle Notch | Output Power for Traction |
|---|---|
| TN0 | 0 |
| TN1 | 15.3 |
| TN2 | 36.72 |
| TN3 | 73.44 |
| TN4 | 107.1 |
| TN5 | 146.88 |
| TN6 | 205.02 |
| TN7 | 257.04 |
| TN8 | 306 |

While the assessment of notches on throttle handle 126 and lead autonomous settings 133 and trail autonomous settings 135 consistent with the present disclosure may be performed using raw power values, normalizing those values to that of a single locomotive can make the data more intuitive. Therefore, in forming power table 400, each of the power values for different throttle positions TN0-TN8 is divided by the full power for the locomotive, i.e., 306 kilopounds at throttle position TN8. The body of power table 400 contains values of equivalent full-power locomotives 402 for consist 118 formed by lead locomotive 110 and nonaddressable locomotive 112. For example, as shown in FIG. 3, the lead locomotive may be operating in autonomous mode at lead autonomous setting 404, which is equivalent to throttle handle 126 being in notch position TN8. At the same time, the trail locomotive may be idling in autonomous mode at trail autonomous setting 406, which is equivalent to throttle handle 126 being in notch position TN0. The power table 400 indicates at the intersection of the row for lead autonomous setting 404 and the column for trail autonomous setting 406 that the tractive power equivalent to one locomotive at full power for the consist is 1.0, labeled as engaged power 412. In other words, the lead locomotive and the trail locomotive operating under respective autonomous settings of TN8 and TN0 generate consist power equivalent to one locomotive at full power.

As another example, it can be seen from power table 400 that lead locomotive 110 and nonaddressable locomotive 112 both operating under autonomous settings of TN8 would generate cumulative power for the consist equivalent to two locomotives at full power at the lower right corner of power table 400. Intersections of other ones of lead autonomous settings 133 and trail autonomous settings 135 indicate the equivalent locomotive power for a consist of a lead locomotive and a trail locomotive. Therefore, the content of power table 400, which could be stored in memory in many different forms known to those of ordinary skill in the field, may provide at least theoretical data indicative of an engaged power in autonomous mode for lead locomotive 110 and nonaddressable locomotive 112 operating at lead autonomous setting 404 and trail autonomous setting 406.

Returning to FIG. 3, a position of a consist throttle that most closely approximates the engaged power is determined in a step 310. In some examples, determining this position of the consist throttle involves predicting power output of each propulsion system 120 of the consist based on data stored in memory, such as power table 400. As shown in FIG. 4, a diagonal across power table 400 from an upper left corner to a lower right corner defines potential disengaged powers 408. Each of the cells along this diagonal correspond to situations where lead autonomous settings 133 and trail autonomous settings 135 are identical, which is the case when consist 118 operates in manual mode. In some examples, consist disengagement module 136 will evaluate one or more of those potential disengaged powers 408 and identify a power value that is closer to the output power of the consist in the autonomous mode (i.e., a value of 1) than others among potential disengaged powers 408. In this example, the result closet to 1.0 would be disengaged power 414 having an equivalent locomotive power of 0.96. In some examples, the disengaged power 414 among potential disengaged powers 408 will be substantially the same as the output power of the consist in the autonomous mode, i.e., the same as engaged power 412. According to power table 400, the disengaged power 414 of 0.96 for the consist corresponds to a disengaged setting 410 of TN5 for both the lead locomotive and the trail locomotive.

In other examples, consist disengagement module 136 may identify a value among potential disengaged powers 408 simply being closer to engaged power 412 than would result from lead locomotive 110 and nonaddressable locomotive 112 both operating at lead autonomous setting 404, which is typically the result of disengagement from a managed consist. Changing trail autonomous setting 406 to match lead autonomous setting 404, i.e., increasing trail autonomous setting 406 to the equivalent of TN8, would lead to excessive power output from the consist. That change in power output would equal doubling the equivalent locomotive power for the consist (from 1.0 to 2.0 in power table 400), which would in turn require contrary action from the operator once in manual mode at least by reducing throttle handle 126. Therefore, a value within potential disengaged powers 408 closer to engaged power 412 than both locomotives being set at lead autonomous setting 404 would be an improvement. The process may also compare engaged power 412 to all of potential disengaged powers 408, evaluate stored data relating to past consist performance, or follow other steps to select disengaged power 414 as the target for entering into manual mode.

After determining that a position of a consist throttle resulting most closely to disengaged setting 410 would be TN5 in FIG. 4, the consist throttle is caused to be moved to position TN5 in step 312. The consist disengagement module 136 can provide that instruction in any suitable way, such as by providing an indication on monitor 128 or otherwise providing visual, audible, or haptic signals to the operator.

After the operator moves throttle handle 126 to TN5 in the present example, the lead autonomous setting and the trail autonomous setting are incrementally changed to be equivalent to that consist throttle position, i.e., TN5 (Step 314). In particular, consist disengagement module 136 may begin incrementally adjusting lead autonomous setting 404 and trail autonomous setting 406 as needed in some examples by evaluating how changes to those settings may impact the values for equivalent full-power locomotives 402. To reach disengaged setting 410, lead autonomous setting 404 would need to be changed through lead intermediate settings 416, and trail autonomous setting 406 would need to be changed through trail intermediate settings 418. With engaged power 412 having a value of 1.0 and disengaged power 414 corresponding to disengaged setting 410 in the example of FIG. 4, consist disengagement module 136 can evaluate the change that would occur to the current consist power by either decreasing lead autonomous setting 404 or increasing trail autonomous setting 406 by one notch. At lead intermediate setting 416A equal to TN7 and trail autonomous setting 406 equal to TN0, the equivalent locomotive power for consist 118 would be 0.84. On the other hand, at lead autonomous setting 404 equal to TN8 and trail intermediate setting 418A equal to TN1, the equivalent locomotive power for consist 118 would be 1.05, as shown in FIG. 4. Because 1.05 more closely approximates the target, disengaged power 414 of 0.96, than does 0.84, consist disengagement module 136 would first opt to increase by one notch the trail autonomous setting.

After that change takes effect within consist 118, consist disengagement module 136 then evaluates the option of decreasing lead autonomous setting 404 by one notch or increasing trail intermediate setting 418A by one notch. Decreasing lead autonomous setting 404 by one notch to equal TN7 would yield an equivalent locomotive power of 0.89, while increasing trail intermediate setting 418A by one notch would result in an equivalent locomotive power of 1.12. Because 0.89 is closer to 0.96 than 1.12, consist disengagement module 136 will decide to decrease the lead autonomous setting to equal TN7. Successive decisions by consist disengagement module 136 to change the locomotive settings in autonomous mode until they each reach TN5 can be appreciated from power table 400. In particular, lead autonomous settings 133 will be changed to lead intermediate setting 416A and lead intermediate setting 416B before reaching disengaged setting 410. Trail autonomous settings 135 will be changed through trail intermediate setting 418A, trail intermediate setting 418B, trail intermediate setting 418C, and trail intermediate setting 418D to reach disengaged setting 410. An evaluation of power table 400 will show that, at least in this example, equivalent full-power locomotives 402 will change from 1.0 to 0.96, 1.08, 0.91, 1.02, 1.15, and then 0.96.

The steps through lead intermediate settings 416 and trail intermediate settings 418 may occur in any sequence for the lead locomotive and the trail locomotive to minimize the change that occurs as the output power for the consist transitions from engaged power 412 to disengaged power 414. Choosing the lead and trail settings for each incremental change that is closer to the value at disengaged power 414 helps consist disengagement module 136 ensure direct movement of consist power to disengaged power 414 with minimal disruption to the operation or handling of train 102. Other processes may be followed to change one or both of the locomotive settings, such as choosing a subsequent throttle setting that results in the smallest change to equivalent locomotive power so that handling remains smooth throughout.

Once the consist power reaches disengaged power 414, consist disengagement module 136 has completed the disengagement process. Accordingly, in step 316, consist disengagement module 136 disengages the consist from the autonomous mode, reverting control over consist power to throttle handle 126. In some examples, energy-management system 130) communicates the completion of disengagement to an operator, such as by providing a visual indication within monitor 128 or generating an audible or haptic signal, for instance. Because the operator has already moved throttle handle 126 to the appropriate notch position, no further movement of throttle handle 126 is required unless the operator wishes to make a change as part of the current manual mode of operation.

Figure 5:
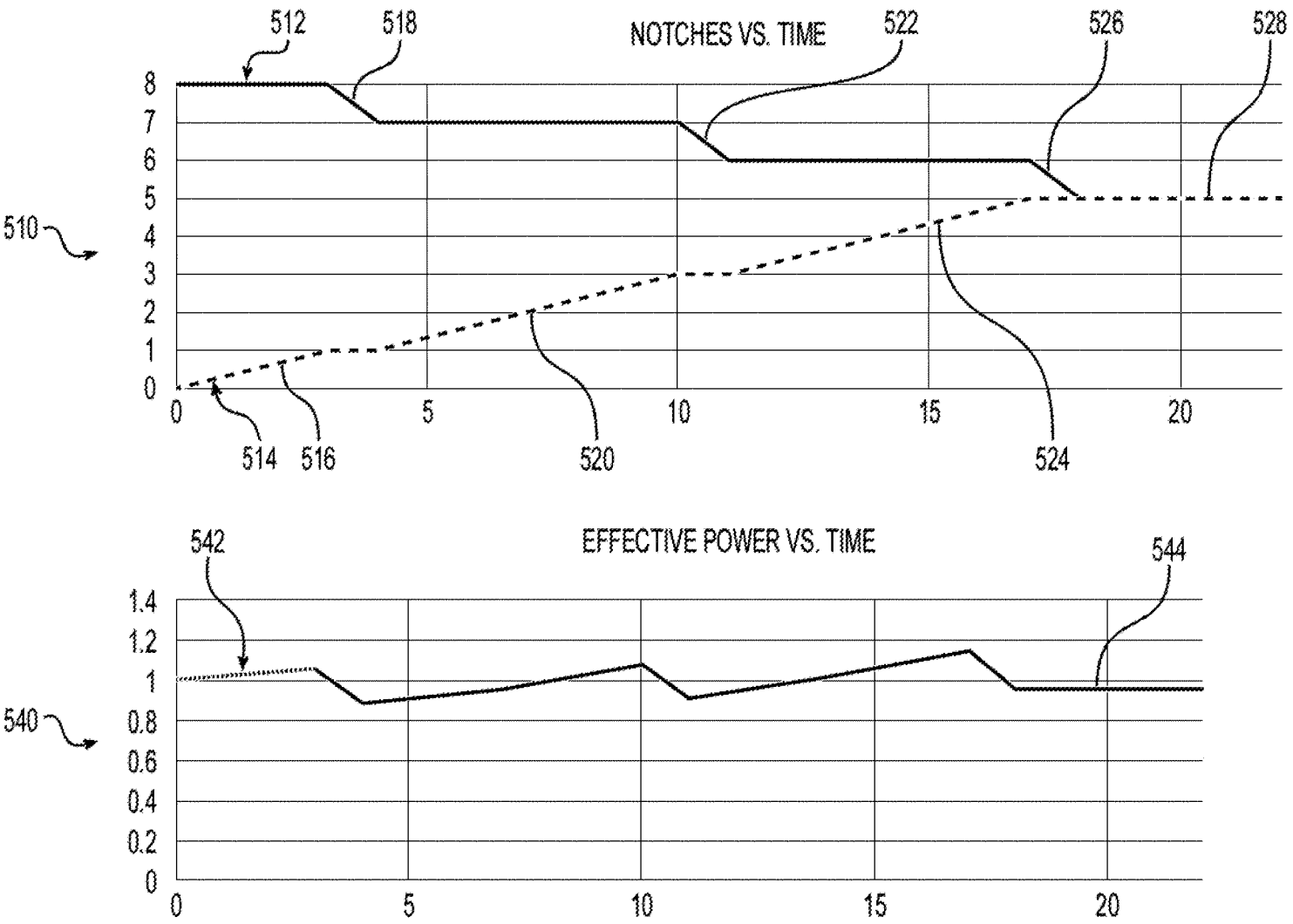
FIG. 5 is a group of graphs depicting throttle notch settings over time and equivalent locomotive power over time for a disengagement process in accordance with an example of the present disclosure.

For these examples, FIG. 5 contains a first graph 510 illustrating notches, or throttle positions, over time and a second graph 540 of effective consist power over time. In first graph 510, as discussed above, lead locomotive 110 begins in autonomous mode at TN8, which is indicated in first graph 510 by lead autonomous setting 512. The non-addressable locomotive 112 begins the process at TN0, which is indicated by trail autonomous setting 514 in FIG. 5. After consist disengagement module 136 decides to increase trail autonomous setting 514 by one notch to TN1 in step 314 of FIG. 3, a first trail increase 516 occurs as the trail throttle is gradually increased until about a time value of 3 in first graph 510. At about that time, trail autonomous setting 514 stabilizes at TN1 while a first lead decrease 518 occurs for lead autonomous setting 512 as consist disengagement module 136 makes the next change at step 314 to decrease the lead throttle one notch. After that decrease is processed, at about time value of 4 in first graph 510, further increases to the trail throttle occur, first to TN2 and then to TN3 as indicated by second trail increase 520. Thereafter, second lead decrease 522 in lead autonomous setting 512 changes lead locomotive 110 to TN6, followed by consist disengagement module 136 changing nonaddressable locomotive 112 from TN3 to TN4 and then to TN5 as shown by third trail increase 524. Finally, with third lead decrease 526, consist disengagement module 136 decreases lead locomotive 110 one more notch to TN5 as well, resulting in the final autonomous setting 528.

Shown in alignment with first graph 510, second graph 540 illustrates how the incremental and gradual walking of autonomous throttle settings for lead locomotive 110 and nonaddressable locomotive 112 in these examples maintains a stable power output for consist 118 during the transition. The equivalent locomotive power 542 slightly increases and decreases over time while the operational settings for lead locomotive 110 and nonaddressable locomotive 112 are modified, but the total output stays within close range of its origin at an equivalent value of 1.0 locomotives and ends at final autonomous power 544 of 0.96 locomotives. It will be appreciated that conventional approaches of setting the throttle of both locomotives to the lead throttle setting would result in significantly higher output power at the consist when entering manual mode (e.g., 2.0 locomotives), and the train would undergo considerably higher fluctuations in output power during the transition. Those of ordinary skill in the field will appreciate that these graphs and values are exemplary only and that smaller or larger deviations in output power may be accomplished based on the desired implementation consistently with the present disclosure.

FIGS. 3-5 describe an example in which consist 118 is formed from lead locomotive 110 and nonaddressable locomotive 112 having identical performance characteristics. The same principles may be extended to managed consists having a larger number of locomotives with different performance characteristics. Specifically, when multiple trail locomotives are present in the consist, the trail locomotives may be combined and treated as a single entity with respect to the methods addressed above and in FIGS. 3-5. For example, assume that a consist of four units were formed from three models of locomotives (A, B, and C) having different power characteristics per throttle notch in units of kilopounds:

| Throttle | Output Power for Traction | | |
|---|---|---|---|
| Notch | Model A | Model B | Model C |
| TN0 | 0 | 0 | 0 |
| TN1 | 8.566038 | 15.3 | 32.675 |
| TN2 | 51.39623 | 36.72 | 65.35 |
| TN3 | 102.7925 | 73.44 | 98.025 |
| TN4 | 137.0566 | 107.1 | 130.7 |
| TN5 | 171.3208 | 146.88 | 163.375 |
| TN6 | 192.7358 | 205.02 | 196.05 |
| TN7 | 205.5849 | 257.04 | 228.725 |
| TN8 | 227 | 306 | 261.4 |

If the lead locomotive were a Model B, and the consist included two trail locomotives of Model A and one of Model C, then table as power table 400 could be formed by treating the different trail locomotives as a single entity. Therefore, the output power per notch for this hypothetical consist in kilopounds would be:

| Throttle | Output Power for Traction | |
|---|---|---|
| Notch | Lead (Model B) | Trail (Models A + A + C) |
| TN0 | 0 | 0 |
| TN1 | 15.3 | 49.80708 |
| TN2 | 36.72 | 168.1425 |
| TN3 | 73.44 | 303.6099 |
| TN4 | 107.1 | 404.8132 |
| TN5 | 146.88 | 506.0165 |
| TN6 | 205.02 | 581.5216 |
| TN7 | 257.04 | 639.8948 |
| TN8 | 306 | 715.4 |

For instance, the trail power at TN6 is the power of A+A+C or 192.7358+192.7358+196.05=581.5216.

If it is desired to convert the powers to be normalized to the power of a single locomotive, the values in the chart above could be divided by the maximum locomotive power of the consist. For this example, Model B has the largest output power of 306 kilopounds. Dividing the power values by 306 yields the following chart of an equivalent locomotive at full power for the consist of A+A+C:

| Throttle Notch | Output Power for Traction | |
|---|---|---|
| | Lead (Model B) | Trail (Models A + A + C) |
| TN0 | 0 | 0 |
| TN1 | 0.05 | 0.162768 |
| TN2 | 0.12 | 0.549485 |
| TN3 | 0.24 | 0.992189 |
| TN4 | 0.35 | 1.322919 |
| TN5 | 0.48 | 1.653649 |
| TN6 | 0.67 | 1.900398 |
| TN7 | 0.84 | 2.09116 |
| TN8 | 1 | 2.337908 |

From this data, a table such as power table 400 in FIG. 4 can be constructed for the consist of A+A+C and the method of FIG. 3 as described above can be applied. Other variations based on this description will be apparent to those of ordinary skill in the field based on an implementation.

Those of ordinary skill in the field will appreciate that the principles of this disclosure are not limited to the specific examples discussed or illustrated in the figures. For example, while the system and method has been discussed in the context of output power from a consist when disengaging from autonomous mode, other operational characteristics of the locomotives may also be controlled and adjusted during the disengagement process to smooth the transition to manual mode. Moreover, the process of disengagement described above may be applied to various types of propulsion systems in locomotives, including diesel-electric and battery-electric models of locomotives.

INDUSTRIAL APPLICABILITY

The present disclosure provides systems and methods for disengaging a train consist from an autonomous mode to a manual mode of operation. An energy-management system of the train includes a consist disengagement module configured to control the disengagement. After receiving an instruction to disengage, the system determines an engaged power of the consist in the autonomous mode and calculates an effective position for a consist throttle where the consist would generate a disengaged power in manual mode most closely approximating the engaged power. After causing the throttle handle to be moved to the effective position, the consist disengagement module incrementally changes the operational settings for either a lead locomotive or a trail locomotive until the operational settings for locomotives in the consist match the effective position for the consist throttle. The system chooses the changes to maintain the consist output power close to the disengaged power. As a result, the consist can move stably through disengagement without surges in consist power and unexpected handling disturbances.

As noted above with respect to FIGS. 1-5, an example method for disengaging a consist from autonomous mode deploying a lead locomotive 110 and one or more trail locomotives within a consist 118 of a train 102 includes providing a lead autonomous setting corresponding to tractive effort to be delivered to lead locomotive 110 in the autonomous mode and providing a different trail autonomous setting to one or more trail locomotives. After receiving an instruction to disengage from the autonomous mode, a consist management module within energy-management system 130 identifies an engaged power of the consist in the autonomous mode. The system then determines a position of throttle handle 126 that in the manual mode would generate a disengaged power closer to the engaged power than other positions of throttle handle 126. An indication may be provided to move throttle handle 126 to the position, and the autonomous settings for lead locomotive 110 and one or more trail locomotives are incrementally changed until they are equivalent to the throttle in the position.

In the examples of the present disclosure, the energy-management system and consist disengagement module can determine an autonomous consist power when disengagement is requested and calculate a throttle position in manual mode that would generate manual consist power most closely approximating the autonomous consist power. Incrementally changing the operational settings for lead locomotive 110 and one or more trail locomotives of consist 118 to match the calculated throttle position, the consist management module ensures that the consist output power remains stable during disengagement. As a result, significant changes in output power that might cause lurches or other driving disturbances can be avoided to enhance safety and comfort in the transition to manual mode.

Unless explicitly excluded, the use of the singular to describe a component, structure, or operation does not exclude the use of plural such components, structures, or operations or their equivalents. As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Terms of approximation are meant to include ranges of values that do not change the function or result of the disclosed structure or process. For instance, the term "about" generally refers to a range of numeric values that one of skill in the art would consider equivalent to the recited numeric value or having the same function or result. Similarly, the antecedent "substantially" means largely, but not wholly, the same form, manner or degree, and the particular element will have a range of configurations as a person of ordinary skill in the art would consider as having the same function or result. As an example, "substantially equal" need not be exactly the same but may also encompass variations of a few percent based on the context.

While aspects of the present disclosure have been particularly shown and described with reference to the embodiments above, it will be understood by those skilled in the art that various additional embodiments may be contemplated by the modification of the disclosed systems and methods without departing from the spirit and scope of what is disclosed. Such embodiments should be understood to fall within the scope of the present disclosure as determined based upon the claims and any equivalents thereof.

What is claimed is:

1. A computer-implemented method, comprising:

operating a consist of locomotives of a train in an autonomous mode, comprising:

providing, to a lead locomotive of the consist, a lead autonomous setting corresponding to tractive effort to be delivered by the lead locomotive in the autonomous mode, providing, to a trail locomotive of the consist, a trail autonomous setting different from the lead autonomous setting and corresponding to tractive effort to be delivered by the trail locomotive in the autonomous mode:

receiving an instruction to disengage the consist from the autonomous mode;

identifying an engaged power of the consist when operating at the lead autonomous setting and the trail autonomous setting:

determining a position of a consist throttle, among a set of positions, resulting in a disengaged power of the consist in a manual mode, wherein the disengaged power is closer to the engaged power with the consist throttle in the position compared with the consist throttle in another of the positions:

causing the consist throttle to be moved to the position:

incrementally changing one of the lead autonomous setting and the trail autonomous setting until the lead autonomous setting and the trail autonomous setting are at a disengagement setting, the disengagement setting being equivalent to the consist throttle being in the position; and disengaging the consist from the autonomous mode.

2. The computer-implemented method of claim 1, wherein the disengaged power is closer to the engaged power with the consist throttle in the position compared with the consist throttle in any other of the positions.

3. The computer-implemented method of claim 1, wherein incrementally changing one of the lead autonomous setting and the trail autonomous setting comprises selecting one of a lead intermediate setting and a trail intermediate setting resulting in a consist power closer to the disengaged power.

4. The computer-implemented method of claim 1, wherein determining the disengaged power comprises accessing data from a memory, the data being indicative of output power for the consist at combinations of the operational settings for the lead locomotive and for the trail locomotive.

5. The computer-implemented method of claim 1, wherein incrementally changing one of the lead autonomous setting and the trail autonomous setting comprises:

determining a first intermediate power value generated by the consist when the lead autonomous setting is changed to a lead intermediate setting, the first intermediate setting being successive to the lead autonomous setting and closer to the disengagement setting:

determining a second intermediate power value generated by the consist when the trail autonomous setting is changed to a second intermediate setting, the second intermediate setting being successive to the trail autonomous setting and closer to the disengagement setting:

comparing the first intermediate power value and the second intermediate power value with the disengaged power:

when the first intermediate power value is closer to the disengaged power than is the second intermediate power value, changing the lead autonomous setting to the lead intermediate setting.

6. The computer-implemented method of claim 1, wherein incrementally changing one of the lead autonomous setting and the trail autonomous setting comprises:

determining a first intermediate power value generated by the consist when the lead autonomous setting is changed to a lead intermediate setting, the first intermediate setting being successive to the lead autonomous setting and closer to the disengagement setting;

determining a second intermediate power value generated by the consist when the trail autonomous setting is changed to a second intermediate setting, the second intermediate setting being successive to the trail autonomous setting and closer to the disengagement setting:

comparing the first intermediate power value and the second intermediate power value with the disengaged power:

when the second intermediate power value is closer to the disengaged power than is the first intermediate power value, changing the trail autonomous setting to the trail intermediate setting.

7. The computer-implemented method of claim 1, wherein the consist includes a second trail locomotive and the disengaged power includes the second trail locomotive operating at the disengaged setting.

8. The computer-implemented method of claim 1, wherein receiving an instruction to disengage the consist comprises one of receiving input through a user interface and detecting movement of the consist throttle.

9. The computer-implemented method of claim 8, wherein causing the consist throttle to be moved comprises providing an instruction through the user interface for manual shifting of the consist throttle.

10. The computer-implemented method of claim 1, wherein incrementally changing one of the lead autonomous setting and the trail autonomous setting comprises adjusting the tractive effort from one of the lead locomotive and the trail locomotive to a successive operational setting over a period of time.

11. A control system for a consist of locomotives, comprising:

a throttle configured to indicate an overall amount of power to be delivered by the consist in a manual mode, settings of the throttle indicating respective levels of the power:

an energy-management system, coupled to the throttle, configured to indicate a first amount of power to be delivered by a lead locomotive of the locomotives and a second amount of power to be delivered by a trail locomotive of the locomotives in an autonomous mode, the energy-management system comprising:

a lead throttle module configured to:

instruct the lead locomotive to provide a lead power equivalent to the throttle being in a lead setting, and in response to the throttle being moved to a disengaged setting, instruct the lead locomotive to change the lead power incrementally to become equivalent to the throttle being in a disengaged setting:

a trail throttle module configured to:

instruct the trail locomotive to provide a trail power equivalent to the throttle being in a trail setting, and in response to the throttle being moved to the disengaged setting, instruct the trail locomotive to change the trail power incrementally to become equivalent to the throttle being in the disengaged setting; and a consist disengagement module configured to:

receive a command to disengage the consist from the autonomous mode:

identify an engaged power of the consist when operating in the autonomous mode:

predict a first power of the consist when the throttle is in the lead setting for the consist:

predict a disengaged power of the consist when the throttle is in the disengaged setting for the consist, the disengaged setting being different than the lead setting:

determine that the disengaged power would be closer to the engaged power than would the first power;

cause the throttle to be moved to the disengaged setting; and disengage the consist from the autonomous mode and into the manual mode.

12. The control system of claim 11, wherein the consist disengagement module is further configured to:

predict another power of the consist when the throttle is in another setting for the consist; and determine that the disengaged power would be closer to the engaged power than the another power.

13. The control system of claim 11, wherein the consist disengagement module is further configured to:

determine that the disengaged power would be closer to the engaged power than would any other power of the consist when the throttle is in a same setting for the lead locomotive and the trail locomotive.

14. The control system of claim 11, wherein the consist includes an additional trail locomotive, the trail throttle module further configured to:

instruct the additional trail locomotive to provide an additional power equivalent to the throttle being in an additional setting, and instruct the additional trail locomotive to change the additional power incrementally to become equivalent to the throttle being in the disengaged setting.

15. The control system of claim 11, wherein the consist disengagement module receives the command to disengage the consist from the autonomous mode from an operator interface within the lead locomotive.

16. A consist of locomotives for a train, comprising:

a lead locomotive including a throttle configured for controlling power from the consist in a manual mode, settings of the throttle indicating respective levels of the power:

a trail locomotive coupled by the lead locomotive via a communication network; and an electronic control system, at least partially within the lead locomotive, configured to control power from the consist in an autonomous mode, the electronic control system configured to:

instruct the lead locomotive to provide a lead power equivalent to the throttle being in a lead setting;

instruct the trail locomotive to provide a trail power equivalent to the throttle being in a trail setting:

receive a command to disengage the consist from the autonomous mode;

identify an engaged power of the consist operating in the autonomous mode:

predict a first power of the consist when the throttle is in the lead setting for the consist;

predict a disengaged power of the consist when the throttle is in a disengaged setting for the consist, the disengaged setting being different than the lead setting:

determine that the disengaged power would be closer to the engaged power than would the first power;

cause the throttle to be moved to the disengaged setting:

instruct the lead locomotive to change the lead power incrementally to become equivalent to the throttle being in the disengaged setting;

instruct the trail locomotive to change the trail power incrementally to become equivalent to the throttle being in the disengaged setting; and disengage the consist from the autonomous mode and into the manual mode.

17. The consist of claim 16, wherein the electronic control system is further configured to:

predict another power of the consist when the throttle is in another setting for the consist; and determine that the disengaged power would be closer to the engaged power than the another power.

18. The consist of claim 16, wherein the electronic control system is further configured to:

determine that the disengaged power would be closer to the engaged power than would any other power of the consist when the throttle is in a same setting for the lead locomotive and the trail locomotive.

19. The consist of claim 16, further comprising:

an additional trail locomotive coupled to the lead locomotive by the communication network, the electronic control system being further configured to:

instruct the additional trail locomotive to provide an additional power equivalent to the throttle being in an additional setting, and instruct the additional trail locomotive to change the additional power incrementally to become equivalent to the throttle being in the disengaged setting.

20. The consist of claim 16, further comprising:

an operator interface, within the lead locomotive, configured to provide controls for interacting with the electronic control module.

* * * * *